US007750868B1

(12) United States Patent
Dunn et al.

(10) Patent No.: US 7,750,868 B1
(45) Date of Patent: Jul. 6, 2010

(54) LOW PROFILE ANTENNA FOR MEASURING THE SHIELDING EFFECTIVENESS OF HEMP PROTECTED ENCLOSURES

(75) Inventors: Scott Dunn, Colorado Springs, CO (US); Scott Eldridge, Colorado Springs, CO (US); Dave Fromme, Colorado Springs, CO (US); Jeff Yowell, Colorado Springs, CO (US); Charles McCrea, Colorado Springs, CO (US)

(73) Assignee: Scientific Applications & Research Associates, Inc, Cypress, CA (US)

( * ) Notice: Subject to any disclaimer, the term of this patent is extended or adjusted under 35 U.S.C. 154(b) by 199 days.

(21) Appl. No.: 12/135,455

(22) Filed: Jun. 9, 2008

(51) Int. Cl.
*H01Q 1/36* (2006.01)

(52) U.S. Cl. ..... 343/895; 343/872

(58) Field of Classification Search ..... 343/895, 343/872
See application file for complete search history.

(56) References Cited

U.S. PATENT DOCUMENTS

| | | | | |
|---|---|---|---|---|
| 5,313,216 | A * | 5/1994 | Wang et al. | 343/700 MS |
| 5,777,587 | A * | 7/1998 | Tsuru et al. | 343/752 |
| 6,853,351 | B1 * | 2/2005 | Mohuchy | 343/895 |
| 2006/0066500 | A1 * | 3/2006 | Carbonari | 343/895 |

* cited by examiner

*Primary Examiner*—Hoang V Nguyen
(74) *Attorney, Agent, or Firm*—Stetina Brunda Garred & Brucker

(57) ABSTRACT

A low profile broadband antenna capable of measuring shielding effectiveness (SE) of a shielded boundary above or below ground for permanent installation behind walls, under floors, above ceilings and other areas with limited transverse (as opposed to lateral) available space is provided. A spiral antenna having a wide operating bandwidth is positioned within the interior of an environmentally sealed enclosure. The enclosure likewise has a low profile suited for installation in such locations.

12 Claims, 3 Drawing Sheets

LOW PROFILE ANTENNA FOR MEASURING THE SHIELDING EFFECTIVENESS OF HEMP PROTECTED ENCLOSURES

CROSS-REFERENCE TO RELATED APPLICATIONS

Not Applicable

STATEMENT RE: FEDERALLY SPONSORED RESEARCH/DEVELOPMENT

Not Applicable

BACKGROUND

1. Technical Field

The present invention relates generally to antenna devices. More particularly, the present invention relates to a low profile, broadband, environmentally sealed spiral shaped antenna deployable under buildings and behind building walls.

2. Related Art

Critical infrastructure and government facilities are protected from High-Altitude Electromagnetic Pulse attacks, where a destructive nuclear device such as an atomic or hydrogen bomb is detonated in the atmosphere. Specifically, the initiated nuclear chain reaction also generates electromagnetic radiation strong enough to disturb or destroy electronic circuits in the vicinity of the explosion through current overloads. Protections typically involve barrier or shield installations on the walls, ceilings, and floors of the building, such as boundary or circumferential Faraday shields. The efficacy of the shield installations, also referred to as shielding effectiveness (SE), must be evaluated periodically to ensure the facility and the critical electronic equipment residing therein is properly protected. Conventional techniques for evaluating shielding effectiveness involve the use of three separate linearly polarized antennas to cover the required frequency range, which is inefficient because of the extra time wasted by changing both antenna type and polarization multiple times in the process of test conduct. Furthermore, these conventional antennas require significant volume to use properly, which is deficient both because of the additional wasted space occupied thereby and because of their inability to be used properly in tight spaces. In particular, such conventional antennas may be as large as 4800 cubic inches. Accordingly, there is a need in the art for improved shielding effectiveness evaluation antennas. Furthermore, there is also a need for permanently deployable low profile antennas.

BRIEF SUMMARY

According to an embodiment of the present invention, there is disclosed an antenna installation assembly for the evaluation of shielding effectiveness of a boundary (circumferential Faraday shield). The antenna installation assembly may include an enclosure that defines a center region and an outer periphery. The depth dimension of the flat enclosure may be substantially less than its lateral dimensions. Furthermore, there may be a conductive spiral antenna that defines a center origin point positioned within the interior of the enclosure. Along these lines, the center origin point may be generally aligned with the center region of the enclosure. The antenna installation assembly may further include a coaxial cable that is in electrical communication with the spiral antenna, and is attached to the center origin point thereof. The coaxial cable may extend toward the outer periphery of the enclosure. There may also be a cable interface in electrical communication with the coaxial cable and attached to the outer periphery of the enclosure. A shielding effectiveness transmit and receive system may be attachable to a pair of antennas in an assembly via the cable interfaces. The present invention will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which.

Common reference numerals are used throughout the drawings and the detailed description to indicate the same elements.

DETAILED DESCRIPTION

The detailed description set forth below in connection with the appended drawings is intended as a description of the presently preferred embodiment of the invention, and is not intended to represent the only form in which the present invention may be constructed or utilized. The description sets forth the functions of the invention in connection with the illustrated embodiment. It is to be understood, however, that the same or equivalent functions may be accomplished by different embodiments that are also intended to be encompassed within the scope of the invention. It is further understood that the use of relational terms such as first and second, top and bottom, and the like are used solely to distinguish one from another entity without necessarily requiring or implying any actual such relationship or order between such entities.

Figure 1:
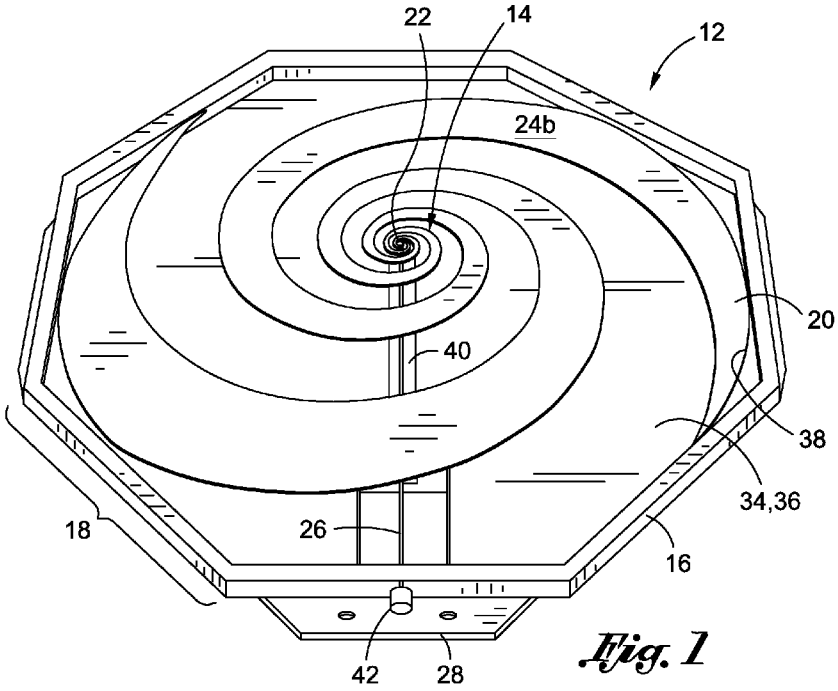
FIG. 1 is a perspective view of the antenna installation assembly without a top member of the enclosure being sealed to a bottom member of the same.

With reference to FIG. 1, there is shown an antenna installation assembly 10 that is contemplated to be deployable at HEMP-protected environments where shielding effectiveness is periodically evaluated. Other uses are also envisioned, including Electromagnetic Interference (EMI) testing and coupling measurements. Such applications require the use of matching antenna assemblies, one for transmit and one for receive. These applications, however, are presented by way of example only and not of limitation, and the antenna installation assembly may be deployed for other applications or purposes. In further detail, it is contemplated that one application of the antenna installation assembly 10 is to be permanently placed under buildings or floors, ceilings and roofs thereof, behind walls, or other like limited spaces. It is understood that the low profile of the antenna installation assembly 10, described in further detail below, makes shielding effectiveness measurement possible when access to floors, either at the ground level or between levels, walls or ceilings is impossible or restricted due to nearby obstacles.

As shown in FIG. 1, the antenna installation assembly 10 includes an enclosure 12 that defines a center region 14 and an outer periphery 16. According to one embodiment of the present invention, the outer periphery 16 is generally defined by edge segments 18, and has an octagonal outline. It will be appreciated by those having ordinary skill in the art, however, that the outer periphery 16 may be variously shaped, and is not limited to an octagonal outline.

The antenna installation assembly 10 also includes a conductive spiral antenna 20 that defines a center origin point 22. The center origin point is understood to be generally aligned with the center region of the enclosure 12. In a preferred, though optional embodiment, the spiral antenna 20 is characterized by counter-rotating dual prongs 24*a*, 24*b* that extend from the center origin point 22. Additionally, in such embodiment, the spiral antenna 20 is contemplated to be constructed from two counter rotating spirals of copper materials. The thickness of the copper plate is understood to be 21.6 mil (16 ounce copper). As will be appreciated by those having ordinary skill in the art, any number of techniques may be used to cut the outline of the spiral antenna 20, including water jet or wire EDM.

Figure 4:
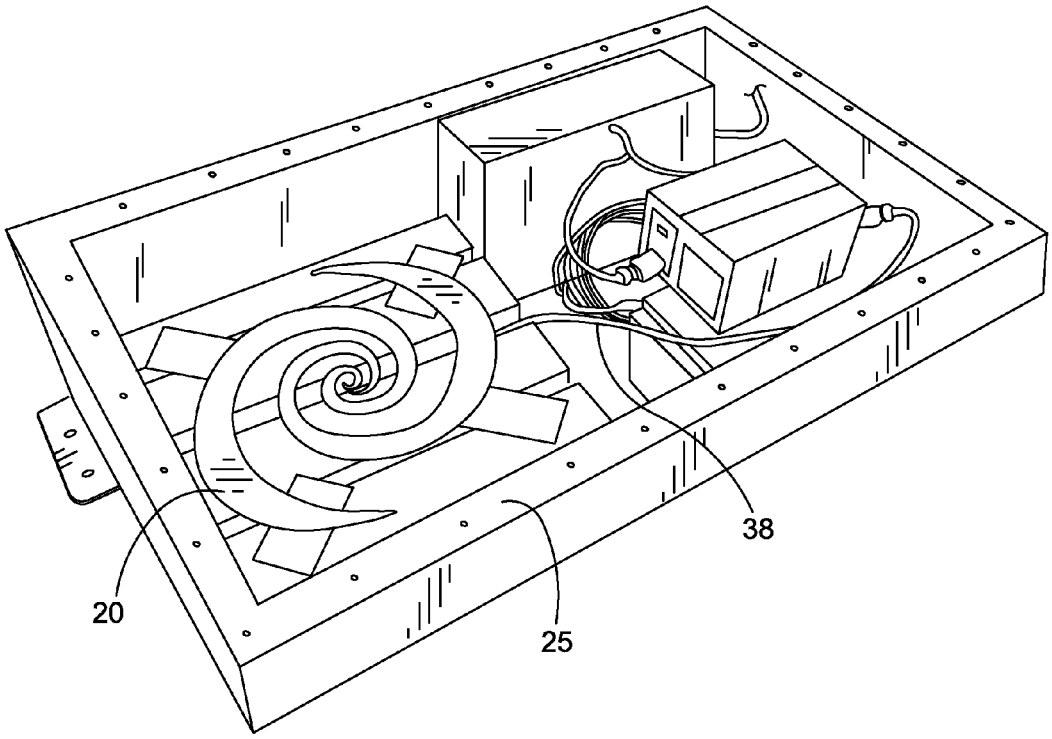
FIG. 4 is a perspective view of a reduced size embodiment of the antenna installation assembly for use with smaller enclosures.

It is expressly contemplated that the spiral antenna 20 have a sufficient gain for evaluating shielding effectiveness against signals ranging between 10 kHz to 1 GHz, which is the full frequency band as set forth in MIL-STD-188-125-1. With further particularity, the spiral antenna 20 is understood to be a passive receive or transmit having a maximum transmission power of 100 watts. As shown in FIG. 4, the physical dimensions of the spiral antenna 20 may be reduced for installation and use in smaller spaces such as a test enclosure 25. It is understood, however, that reduction in the size of the spiral antenna 20 limits the operational frequency range, specifically, in the lower frequency regions.

Figure 2:
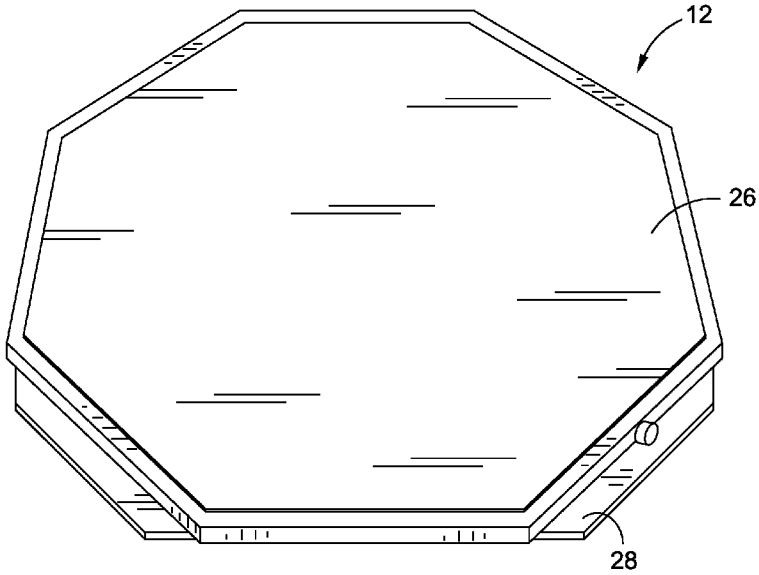
FIG. 2 is a perspective view of the antenna installation assembly with the sealed enclosure in which the top member is attached to the bottom member.

With reference to FIGS. 1 and 2, the enclosure 12 is defined by a top member 26 mated to a bottom member 28. It is contemplated that the bottom member 28 has a substantial thickness, with the top member 26 being a lid or cover without a substantial thickness relative to that of the bottom member 28. In other words, the bottom member 28 primarily defines the depth of the enclosure 12. Along these lines, the depth dimension of the enclosure 12 is substantially less than the lateral dimensions of the same. More particularly, the enclosure 12 may have lateral dimension of 36 inches by 36 inches, and a depth dimension of 2 inches in accordance with one embodiment of the present invention. As indicated above, the slim depth dimensions permit the placement of the antenna installation 10 in a variety of space-constrained locations.

Figure 3:
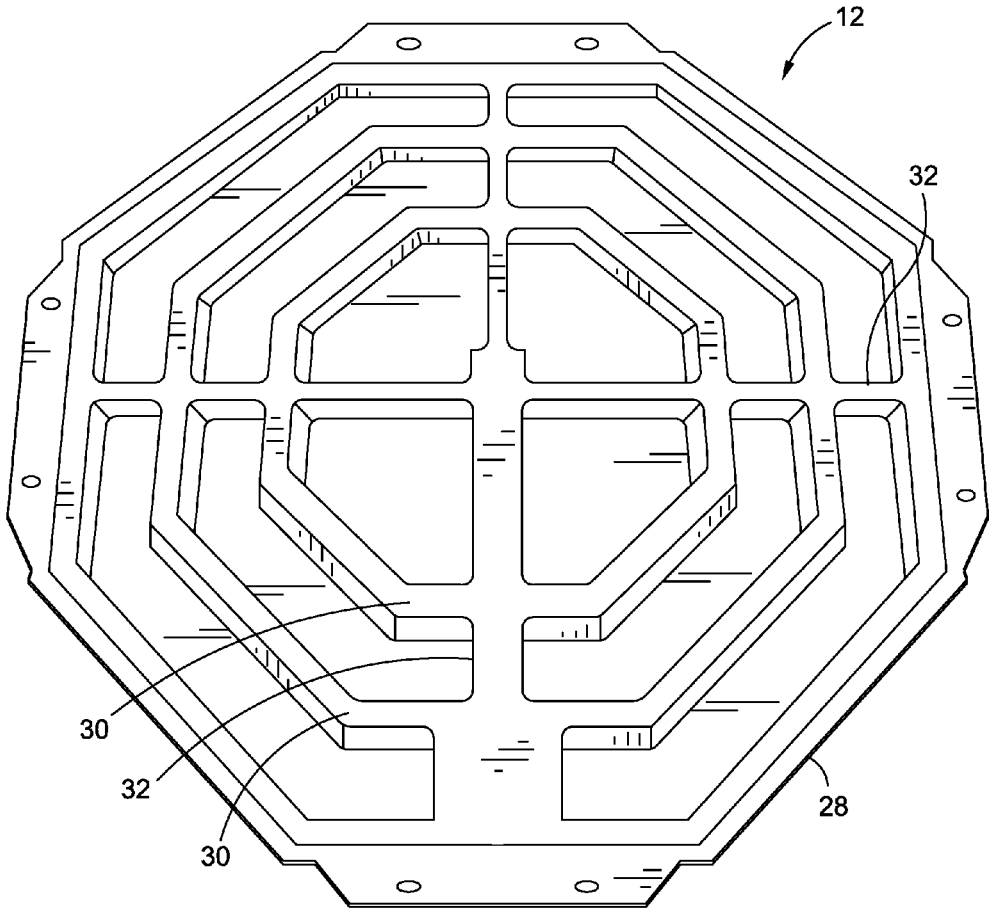
FIG. 3 is a bottom plan view of the enclosure in accordance with one embodiment of the present invention including a plurality of concentric support ribs and intersecting cross members.

Referring to FIG. 3, the bottom member 28 defines one or more concentric support ribs 30. The support ribs 30 are further reinforced with intersecting cross members 32 that extend from one edge segment 18 to another one opposed thereto. As described above, it is contemplated that the antenna installation assembly 10 be deployed under floors where loads may be placed onto the enclosure 12. In this regard, it is understood that the concentric support ribs 30 and the cross members 32 further buttress the enclosure 12, thereby increasing the ability to withstand reasonable center pressure and reducing potentially dangerous flexing of the same.

As illustrated in FIG. 1, the spiral antenna 20 is mounted to the interior of the enclosure 12. More specifically, the spiral 20 is glued to the enclosure 12, though any other suitable attachment modality may be readily substituted without departing from the scope of the present invention. According to one embodiment, the enclosure 12 further includes an antenna support member 34 that is receivable within the bottom member 28. The antenna support member 34 optionally defines an upper surface 36 having a spiral groove 38 that conforms to the outline of the spiral antenna 20. It is contemplated that the spiral antenna 20 be placed in the spiral groove 38 in a fitted relationship for improved sealing characteristics. Though described in terms of independent components, the bottom member 28 and the antenna support member 34 may be integrally formed and be of a unitary construction.

As shown in FIG. 2, the enclosure 12 is defined by the top member 26 being mated to the bottom member 28. According to an embodiment of the present invention, the enclosure 12 may be environmentally sealed for improved weather resistance. It will be appreciated that the enclosure 12 may be deployed in all types of harsh environments for extended periods of time. Along these lines, the enclosure 12 is constructed of acrylonitrile butadiene styrene (ABS) plastic, though any other suitably durable material may be substituted. Generally, the enclosure 12 may be constructed with a thermoforming process.

In order to provide an interface to the spiral antenna 20 through which an external shielding effectiveness test device may be connected, the antenna installation assembly 10 further includes a coaxial cable 26. The cable 26 is in electrical communication with the spiral antenna 20, and attached to the center origin point 22 thereof. From the center origin point 22, the cable 26 extends outwards toward the outer periphery 16 of the enclosure 12. In further detail, the antenna support member 34 defines a channel 40 extending from the outer periphery 16 to the center region 14, with the cable 26 being routed therethrough.

As shown in FIG. 1, the cable 26 is coupled to a cable interface 42. The cable interface 42 is mounted to one of the edge segments 18 of the enclosure 12 in recessed relation to the outer periphery 16. This placement relationship is contemplated to provide protection for the cabling of the external shielding effectiveness test device and its associated connectors, as well as for the cable interface 42 itself. In accordance with one embodiment of the present invention, the cable interface 42 is an "N" type female RF connector.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

What is claimed is:

1. An antenna installation assembly for the evaluation of shielding effectiveness of a boundary, comprising:

an enclosure defining a center region and an outer periphery;

a conductive spiral antenna defining a center origin point positioned within the interior of the enclosure, the center origin point being generally aligned with the center region of the enclosure;

a coaxial cable in electrical communication with the spiral antenna and attached to a center origin point thereof, the coaxial cable extending toward the outer periphery of the enclosure; and a cable interface in electrical communication with the coaxial cable and mounted to the enclosure, a shielding effectiveness test device being attachable to the assembly via the cable interface;

wherein a depth dimension of the enclosure is substantially less than lateral dimensions of the enclosure.

2. The antenna installation assembly of claim 1, wherein the spiral antenna is defined by counter rotating dual spirals extending from the center origin point.

3. The antenna installation assembly of claim 1, wherein the spiral antenna has a sufficient gain with necessary measurement range above the noise for the evaluation of shielding effectiveness for signals ranging in frequency from 10 kHz to 1 GHz.

4. The antenna installation assembly of claim 1, wherein the enclosure is environmentally sealed.

5. The antenna installation assembly of claim 1, wherein the enclosure is further defined by a top member mated to a bottom member.

6. The antenna installation assembly of claim 5, wherein the bottom member defines one or more concentric support ribs and intersecting cross members for reinforcement of the enclosure.

7. The antenna installation assembly of claim 5, further comprising:

an antenna support member receivable within the bottom member, the antenna support member defining an upper surface with a spiral groove conforming to the shape of the spiral antenna.

8. The antenna installation assembly of claim 7, wherein the antenna support member and the bottom member are integrally formed and are of a unitary construction.

9. The antenna installation assembly of claim 7, wherein the antenna support member further defines a channel extending from the outer periphery to the center region, the coaxial cable being routed through the channel.

10. The antenna installation assembly of claim 1, wherein the enclosure is thermoformed plastic.

11. The antenna installation assembly of claim 1, wherein the conductive spiral antenna is comprised of sections of copper plated circuit boards, each of the sections being brazed together at the mating edges thereof.

12. The antenna installation assembly of claim 1, wherein the cable interface is mounted to the enclosure in a recessed relation to the outer periphery.

* * * * *